US010492537B2

(12) United States Patent
Qiu

(10) Patent No.: US 10,492,537 B2
(45) Date of Patent: Dec. 3, 2019

(54) ATOMIZER HEAD, ATOMIZER AND ELECTRONIC CIGARETTE CONTAINING THE ATOMIZER

(71) Applicant: Joyetech Europe Holding GmbH, Zug (CH)

(72) Inventor: Weihua Qiu, Jiangsu (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 279 days.

(21) Appl. No.: 15/713,257

(22) Filed: Sep. 22, 2017

(65) Prior Publication Data

US 2018/0077968 A1 Mar. 22, 2018

(30) Foreign Application Priority Data

Sep. 22, 2016 (CN) ..... 2016 1 0846527

(51) Int. Cl.
*A24F 47/00* (2006.01)
*H05B 3/03* (2006.01)
*F22B 1/28* (2006.01)

(52) U.S. Cl.
CPC ..... *A24F 47/008* (2013.01); *F22B 1/284* (2013.01); *H05B 3/03* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 10,285,447 | B2 * | 5/2019 | Li | A24F 47/008 |
| 2018/0077968 | A1 * | 3/2018 | Qiu | A24F 47/008 |
| 2018/0310627 | A1 * | 11/2018 | Qiu | A24F 7/00 |
| 2019/0124994 | A1 * | 5/2019 | Qiu | A24F 47/008 |
| 2019/0191772 | A1 * | 6/2019 | Qiu | A24F 47/008 |

* cited by examiner

*Primary Examiner* — James Harvey
(74) *Attorney, Agent, or Firm* — Novick, Kim & Lee, PLLC; Allen Xue

(57) ABSTRACT

An atomizer head including an atomizing heating assembly is provided. The atomizing heating assembly includes a first electrode seat, a second electrode seat insulatedly mounted to the first electrode seat and a heating element electrically connected to the first electrode seat and the second electrode seat. The first electrode seat is provided with a first gripping base. The second electrode seat is provided with a second gripping base. The heating element is detachably connected to the first electrode seat and the second electrode seat respectively through the first gripping base and the second gripping base. An atomizer including the atomizer head and an electronic cigarette including the atomizer are further disclosed. The heating element of the atomizer head according to the present disclosure is detachably gripped on the first gripping base and the second gripping base to facilitate the replacement of the heating element.

20 Claims, 12 Drawing Sheets

ATOMIZER HEAD, ATOMIZER AND ELECTRONIC CIGARETTE CONTAINING THE ATOMIZER

CROSS REFERENCE TO RELATED APPLICATIONS

This application claims priority to Chinese Patent Application NO. 201610846527.5, filed on Sep. 22, 2016, the entire disclosure of which is hereby incorporated by reference.

FILED

The present disclosure relates to the field of electronic cigarette, and more particularly, to an atomizer head, an atomizer and an electronic cigarette including the atomizer.

BACKGROUND

The heating element in the atomizer head of existing electronic cigarettes is usually fixed, which is not easy to detach and replace.

SUMMARY

In view of the above, to satisfy the needs of the market, it is necessary to provide an atomizer head, an atomizer and an electronic cigarette comprising the atomizer which enable ease of disassembly.

According to one aspect of the present disclosure, an atomizer head including an atomizing heating assembly is disclosed. The atomizing heating assembly includes a first electrode seat, a second electrode seat insulatedly mounted to the first electrode seat and a heating element electrically connected to the first electrode seat and the second electrode seat. The first electrode seat is provided with a first gripping base. The second electrode seat is provided with a second gripping base. The heating element is detachably connected to the first electrode seat and the second electrode seat respectively through the first gripping base and the second gripping base.

Further, the atomizer head further includes an atomizing tube. A positioning plate is provided inside a tube cavity of the atomizing tube along the direction of diameter of the atomizing tube. The positioning plate is provided with a third fixing groove along the axial direction of the atomizing tube. The atomizing tube is sleeved on a periphery of the heating element, and the heating element is further detachably engaged in the third fixing groove.

Further, a peripheral wall of the atomizing tube is provided with an exudate slot along the axial direction of the atomizing tube, and the peripheral wall of the atomizing tube adjacent to a bottom of the atomizing tube is provided with an air inlet hole.

Further, two gripping openings which grip two ends of the first electrode seat are provided at the bottom of the peripheral wall of the atomizing tube.

Further, the first electrode seat includes a bottom tube, a flat plate disposed on the top of the bottom tube, a supporting plate vertically disposed on the flat plate, and a mounting plate horizontally disposed on the supporting plate. The first gripping base is arranged on a top surface of the mounting plate. The top surface of the mounting plate is provided with a mounting hole. The supporting plate is provided with a mounting slot and a ventilation hole. The bottom of the mounting slot extends through the flat plate and communicates with the tube cavity of the bottom tube. The top of the mounting slot extends through the mounting plate and communicates with the mounting hole. The mounting hole cooperates with the mounting slot to mount the second electrode seat.

Further, the second electrode seat includes a rod body and a plate body connected to the top of the rod body. The second gripping base is arranged on a top surface of the plate body. The rod body is inserted into the mounting slot and projected into the bottom tube, and the plate body is mounted in the mounting hole.

Further, the atomizing heating assembly further includes an insulation sleeve, a conducting part and an insulated ring. The insulation sleeve is mounted in the mounting hole to insulate the plate body from the first electrode seat. The conducting part is mounted in the tube cavity of the bottom tube and engaged with an end of the rod body. The insulated ring is sleeved on an outer periphery of the conducting part to insulate the conducting part from the first electrode seat.

Further, the atomizing heating assembly further includes two clipping pieces mounted in the first gripping base and the second gripping base respectively, and two conductive gripping parts are provided at the bottom of the heating element corresponding to the two clipping pieces.

In addition, the present disclosure provides an atomizer including the atomizer head assembly which includes the atomizer head.

In another aspect, the present disclosure further provides an electronic cigarette including the atomizer.

Compared to the prior art, the heating element of the atomizer head according to the present disclosure is detachably gripped on the first gripping base and the second gripping base to facilitate the replacement of the heating element.

Preferred embodiments of the present disclosure and their advantageous effects will be further described in details with reference to the following description.

DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

LIST OF COMPONENTS AND THE REFERENCE SIGNS

| | | | |
|---|---|---|---|
| Liquid storage assembly: 10 | Conducting part: 54 | Lower guiding groove: 227 | Air adjusting hole: 502 |
| Liquid storage tube: 11 | Insulated ring: 55 | Guiding wall: 228 | Bottom tube: 511 |
| Sealing ring: 12 | Clipping piece: 56 | Center hole: 231 | Flat plate: 512 |
| Top connection assembly: 20 | Heating element: 57 | Liquid injection opening: 232 | Supporting plate: 513 |
| Liquid filling cap: 21 | Second shaft hole: 204 | Positioning projection 233 | Mounting plate: 514 |
| Rotary cap: 22 | Boss: 210 | First fixing groove: 234 | First gripping base: 515 |
| Sealing sheet: 23 | Smoke passing hole: 211 | Top plate: 241 | Mounting hole: 516 |
| Top cover: 24 | Loop: 212 | Annular wall: 242 | Mounting slot: 517 |
| Elastic element: 25 | Liquid injection hole: 213 | Cigarette holder hole: 243 | Ventilation hole: 518 |
| Cigarette holder: 26 | First shaft hole: 214 | Connection ring: 244 | Rod body: 521 |
| First rotating pin shaft: 27 | Positioning hole: 215 | Second fixing groove: 245 | Plate body: 522 |
| Second rotating pin shaft: 28 | Connection sleeve: 216 | Locking projection: 246 | Second gripping base: 523 |
| Atomizer head assembly: 30 | First engagement groove: 217 | Nozzle portion: 261 | Conductive gripping part: 571 |
| Connection tube: 31 | Opening: 218 | Smoke guiding sleeve: 262 | Air inlet hole: 3214 |
| Atomizer head: 32 | Sleeve ring: 219 | Connection tube base: 311 | Stepped surface: 2221 |
| Base assembly: 40 | Smoke outlet hole: 221 | Connection tube sleeve: 312 | Liquid inlet hole: 3121 |
| Base body: 41 | Holding sleeve: 222 | Atomizing tube: 321 | Positioning plate: 3211 |
| Air adjusting assembly: 50 | Pin shaft connection hole: 223 | Atomizing heating assembly: 322 | Third fixing groove: 3212 |
| First electrode seat: 51 | Pin shaft sliding groove: 224 | Base body bottom plate 411 | Exudate slot: 3213 |
| Second electrode seat: 52 | Second engagement groove: 225 | Base body peripheral wall: 412 | Gripping opening: 3215 |
| Insulation sleeve: 53 | Upper guiding groove: 226 | Air adjusting ring: 501 | Air intake groove 4121 |

DETAILED DESCRIPTION

In the following description of embodiments, reference is made to the accompanying drawings which form a part hereof, and in which it is shown by way of illustration specific embodiments of the disclosure that can be practised. It is to be understood that other embodiments can be used and structural changes can be made without departing from the scope of the disclosed embodiments.

Figure 1:
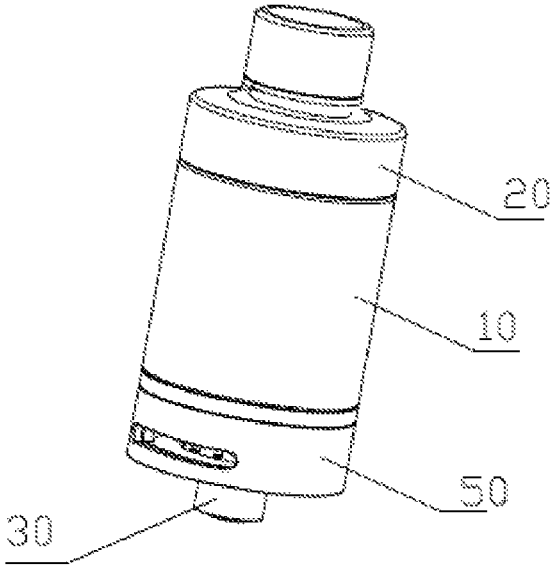
FIG. 1 is a perspective view of an atomizer according to an embodiment of the present disclosure.
Figure 2:
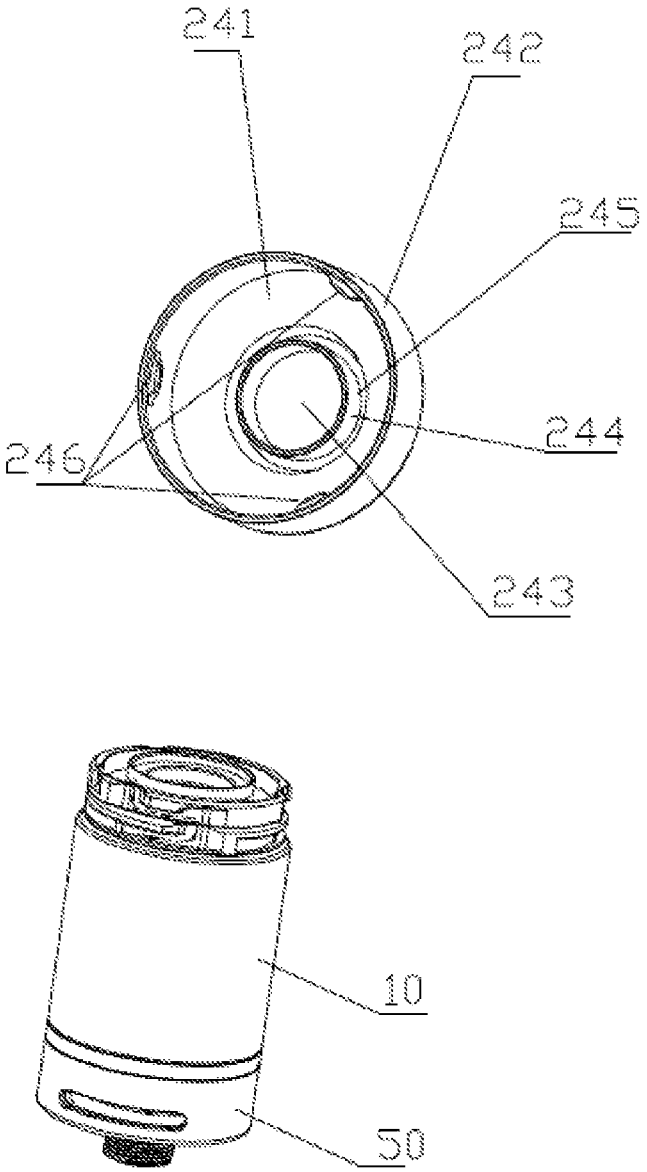
FIG. 2 is a state diagram of the atomizer shown in FIG. 1 after opening a top cover.
Figure 3:
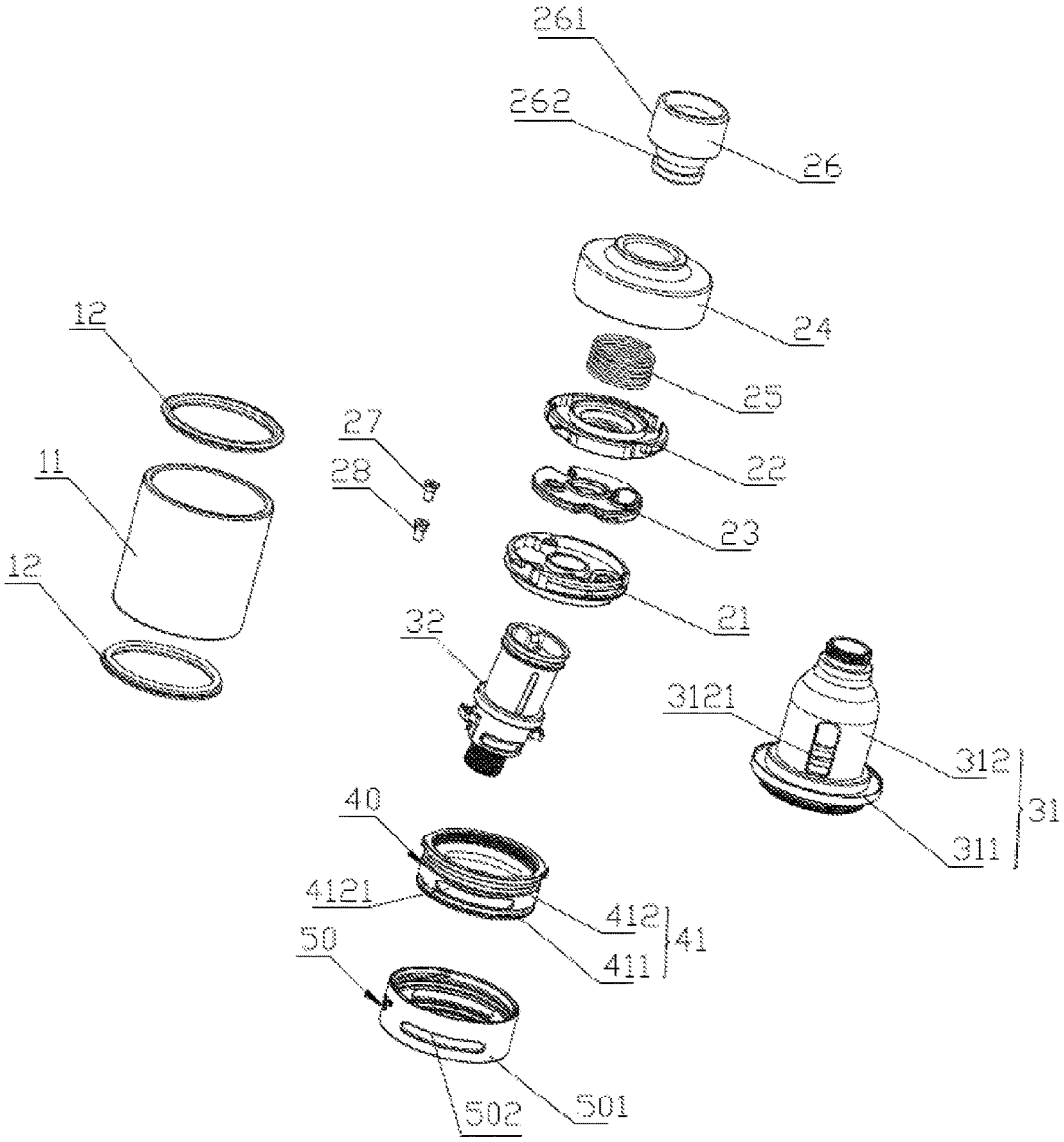
FIG. 3 is an exploded view of the atomizer shown in FIG. 1.

Referring to FIGS. 1, 2 and 3, the present disclosure provides an atomizer of an electronic cigarette including a liquid storage assembly 10, a top connection assembly 20, an atomizer head assembly 30, a base assembly 40 and an air adjusting assembly 50. The top connection assembly 20 covers the top of the liquid storage assembly 10 and serves as a smoking end for the user. One end of the atomizer head assembly 30 is disposed inside the liquid storage assembly 10 to atomize a tobacco liquid, and the opposite end of the atomizer head assembly 30 seals the bottom of the liquid storage assembly 10 and is connected to an external power supply through the base assembly 40. The air adjusting assembly 50 surrounding the base assembly 40 is configured to adjust the volume of the airflow flowing into the atomizer head assembly 30.

The liquid storage assembly 10 includes a liquid storage tube 11 and two sealing rings 12 sleeved on the two opposite ends of the liquid storage tube 11. In this embodiment, the liquid storage tube 11 is a glass tube, so that the user can clearly see the amount of the tobacco liquid stored.

With reference to FIG. 3, the top connection assembly 20 includes an liquid filling cap 21, a rotary cap 22, a sealing sheet 23, a top cover 24, an elastic element 25, a cigarette holder 26, a first rotating pin shaft 27 and a second rotating pin shaft 28.

Figure 4:
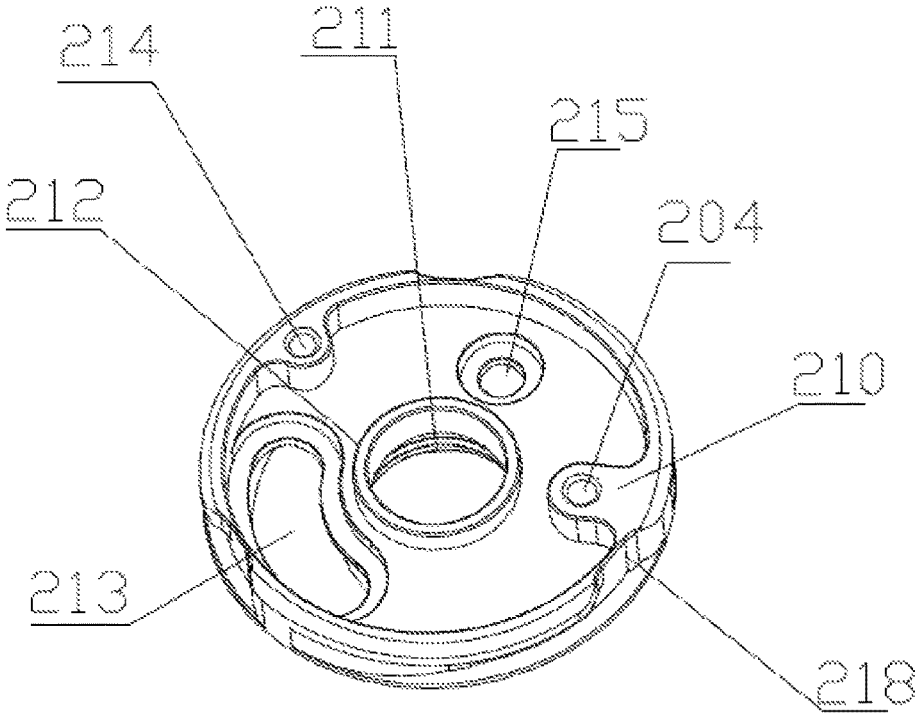
FIG. 4 is a perspective view of a liquid filling cap of the atomizer shown in FIG. 1.
Figure 5:
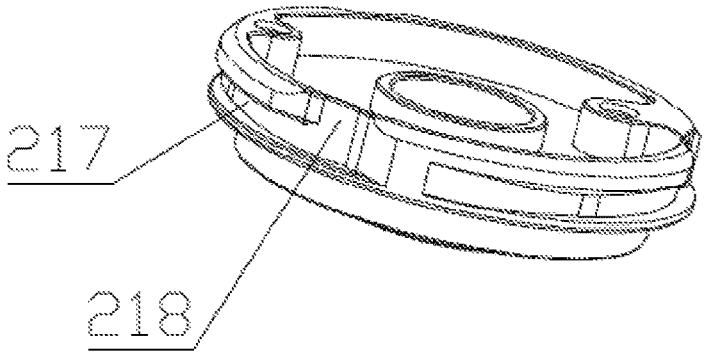
FIG. 5 is another perspective view of the liquid filling cap shown in FIG. 4.

With reference to FIG. 4 and FIG. 5, the liquid filling cap 21 includes a cover plate portion and a peripheral wall formed on outer periphery of the cover plate portion. The peripheral wall is projected to a predetermined height with respect to upper surface of the cover plate portion. A smoke passing hole 211 is formed in the center of the cover plate portion, and a loop 212 is projected on the upper surface of the cover plate portion corresponding to the outer periphery of the smoke passing hole 211. The cover plate portion is further provided with an liquid injection hole 213, a first shaft hole 214, a second shaft hole 204 and a positioning hole 215. The liquid injection hole 213 is located on one side of the smoke passing hole 211 for injecting tobacco liquid. The first shaft hole 214 is for inserting the first rotating pin shaft 27, and the second shaft hole 204 is for inserting the second rotating pin shaft 28. The first rotating pin shaft 27 and the second rotating pin shaft 28 may both be a T-pin shaft. One end of the first rotating pin shaft 27 and one end of the second rotating pin shaft 28 are both respectively locked on the cover plate portion, and the other ends both respectively protruded from the surface of the cover plate portion. The positioning hole 215 is for alignment and positioning when the sealing sheet 23 is mounted on the liquid filling cap 21.

Figure 13:
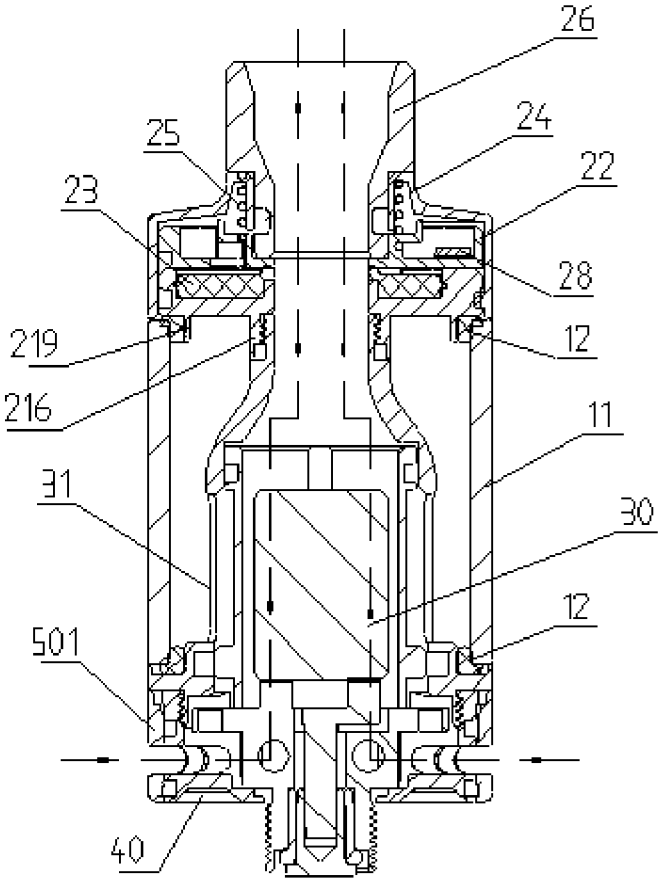
FIG. 13 is a sectional view of the atomizer shown in the FIG. 1.

Referring to FIG. 13, a connection sleeve 216 and a sleeve ring 219 are projected downwardly from the lower surface of the cover plate portion. The connection sleeve 216 is projected along outer periphery of the smoke passing hole 211, and the inner peripheral surface of the connection sleeve 216 is formed with a thread for the connection with the atomizer head assembly 30. The sleeve ring 219 is adjacent to the outer periphery of the lower surface of the cover plate portion for connecting to the liquid storage tube 11 with the seal ring 12. The outer peripheral side of the peripheral wall of the liquid filling cap 21 is provided with a first engagement groove 217 extending circumferentially along the liquid filling cap 21, and an opening 218 extending in the axial direction of the liquid filling cap 21 and communicating with the first engagement groove 217. The first engagement groove 217 extends along the outer periphery of the liquid filling cap 21, and is divided into a plurality of sections by arranging a plurality of partition walls, and correspondingly a plurality of the opening portions 218 are provided. In this embodiment, the first engagement groove 217 is divided into three sections, and three openings 218 are equidistantly provided on the upper side of the first engagement groove 217. The cover plate portion further provides a boss 210 cooperating with the positioning hole 215 to position the sealing sheet 23. In the present embodiment, there are two bosses 210, and the first shaft hole 214 and the second shaft hole 204 are respectively provided in one of the two bosses 210.

Figure 6:
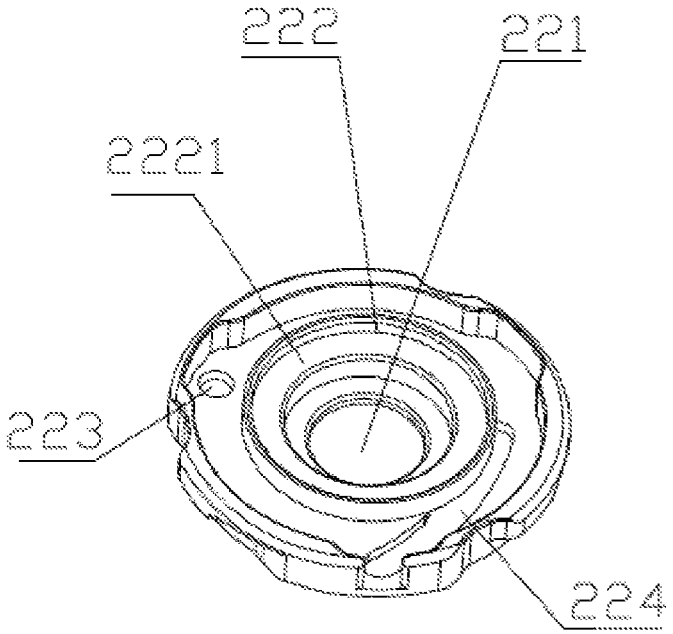
FIG. 6 is a perspective view of a rotary cap of the atomizer shown in FIG. 1.

With reference to FIG. 6, the rotary cap 22 includes a main plate portion and a peripheral wall formed on outer periphery of the main plate portion. The peripheral wall is projected to a predetermined height with respect to upper surface of the main plate portion. A smoke outlet hole 221 is formed in the center of the main plate portion, and a holding sleeve 222 is integrally provided on the upper surface of the main plate portion surrounding the smoke outlet hole 221. The holding sleeve 222 abuts against one end of the elastic element 25 and directs smoke into the cigarette holder 26. In this embodiment, the holding sleeve 222 is a two-stage sleeve connection. The upper-stage sleeve has a larger internal diameter than that of the lower-stage sleeve (i.e., the sleeve connected to the surface of the main plate portion). Correspondingly, a stepped surface 2221 is formed at the connection of the upper-stage sleeve and the lower-stage sleeve to abut against the elastic element 25. The main plate portion is provided with a pin shaft connection hole 223 and a pin shaft sliding groove 224. The pin shaft connection hole 223 corresponds to the size of the projecting end of the first rotating pin shaft 27 for fitting the projecting end of the first rotating pin shaft 27. The projecting end of the second rotating pin shaft 28 is slidably received in the pin shaft sliding groove 224. The pin shaft sliding groove 224 has a predetermined length, so that the rotary cap 22 can be rotated around the first rotating pin shaft 27 mounted in the pin shaft connection hole 223. Therefore, the liquid injection hole 213 covered by the rotary cap 22 can be exposed for injecting liquid. Since the second rotating pin shaft 28 fitted in the pin shaft sliding groove 224 can only slide along the pin shaft sliding groove 224, thus limiting the rotation stroke of the rotary cap 22.

Figure 7:
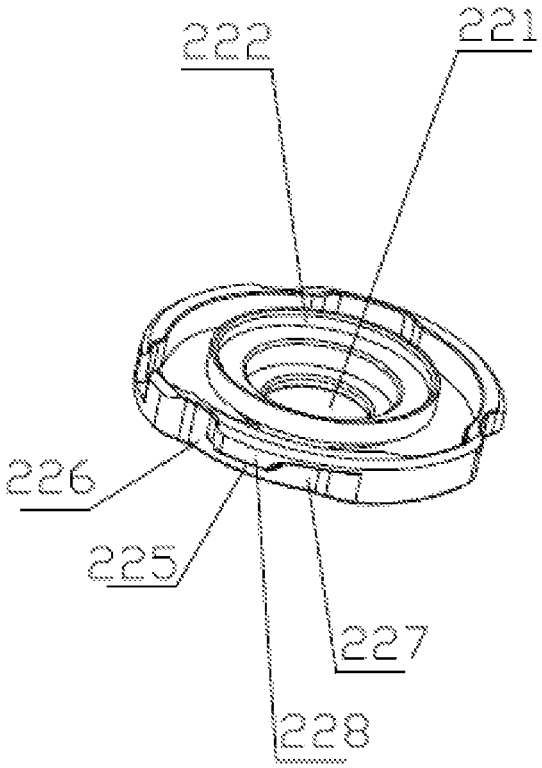
FIG. 7 is another perspective view of the rotary cap shown in FIG. 6.

Referring to FIG. 7, the outer peripheral side of the peripheral wall of the rotary cap 22 is provided with a second engagement groove 225 extending circumferentially along the rotary cap 22 to a predetermined length. One end of the second engagement groove 225 is provided with an upper guiding groove 226 extending axially upward from one end of the second engagement groove 225 along the rotary cap 22. The opposite end of the second engagement groove 225 is provided with a lower guiding groove 227 extending axially downward from the other end of the second engagement groove 225 along the rotary cap 22. A guiding wall 228 formed on the upper side of the second engagement groove 225 is located between the upper guiding groove 226 and the lower guiding groove 227. It can be appreciated that the second engagement groove 225 provided on the outer peripheral side of the peripheral wall of the rotary cap 22 may be more than two, and in this embodiment provides three equally spaced second engagement groove 225. In addition, the lower wall portion constituting the second engagement groove 225 may be omitted.

Figure 8:
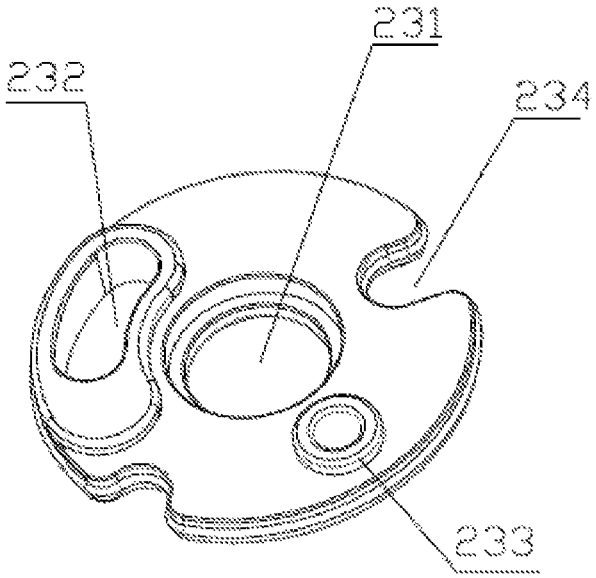
FIG. 8 is a perspective view of a sealing sheet of the atomizer shown in FIG. 1.

Referring to FIG. 8, the sealing sheet 23 is provided on the liquid filling cap 21 and located between the rotary cap 22 and the liquid filling cap 21. The sealing sheet 23 may be made of a silicone material. The sealing sheet 23 is provided with a central hole 231 corresponding to the position of the smoke passing hole 211 on the liquid filling cap 21, and a liquid injection opening 232 corresponding to the position of the liquid injection hole 213. The sealing sheet 23 is provided with a positioning protrusion 233 for engaging with the positioning hole 215, and two first fixing grooves 234 for engaging with the corresponding bosses 210, so that the sealing sheet 23 can be accurately mounted on the liquid filling cap 21.

Referring again to FIG. 2, the top cover 24 includes a top plate 241 and an annular wall 242 provided at the periphery of the top plate 241. A cigarette holder hole 243 for mounting the cigarette holder 26 is formed in the center of the top plate 241. A connection ring 244 is formed on the circumference of the cigarette holder hole 243 so as to fixedly connect with one end of the elastic element 25. In this embodiment, the cigarette holder hole 243 is provided as a stepped through hole. A second fixing groove 245 is defined on the top plate 241 along the outer peripheral surface of the connection ring 244, and the one end of the elastic element 25 is affixed in the second fixing groove 245. The inner peripheral surface of the annular wall 242 is provided with at least two locking projections 246 projecting toward the cigarette holder hole 243 for engaging with the first engagement groove 217 and the second engagement groove 225 to securely connect the top cover 24 to the liquid filling cap 21. In this embodiment, the number of the locking projection 246 is three, equally spaced apart from one another. One end of the elastic element 25 is connected to the connection ring 244, the opposite end of the elastic element 25 is connected to the holding sleeve 222. Since the first engagement groove 217 and the second engagement groove 225 together form a turn-back groove, it is necessary to press the top cover 24, so that the locking projection 246 downwardly slides into the second engagement groove 225 through the upper guiding groove 226, then slides along the second engagement groove 225 to the lower guiding groove 227, slides down into the opening 218, and finally can be screwed into the first engagement groove 217, and thus the top cover 24 is locked with the liquid filling cap 21. The operation of releasing the top cover 24 is opposite to the rotation direction of its locking. Taking into account that a child may come in possession of the electronic cigarette and that the process of releasing the locked top cover 24 is required to be successively performed by a series of continuous operations, the engagement of the top cover 24 with the liquid filling cap 21 has a child protection function.

The cigarette holder 26 is mounted in the cigarette holder hole 243 and includes a nozzle portion 261 and a smoke guiding sleeve 262 integrally connected to the nozzle portion 261. The smoke guiding sleeve 262 cooperates with the rotary cover 22 to allow the smoke flowing out from the smoke outlet hole 221 to flow into the smoke guiding sleeve 262 and then flow out from the nozzle portion 261.

Figure 9:
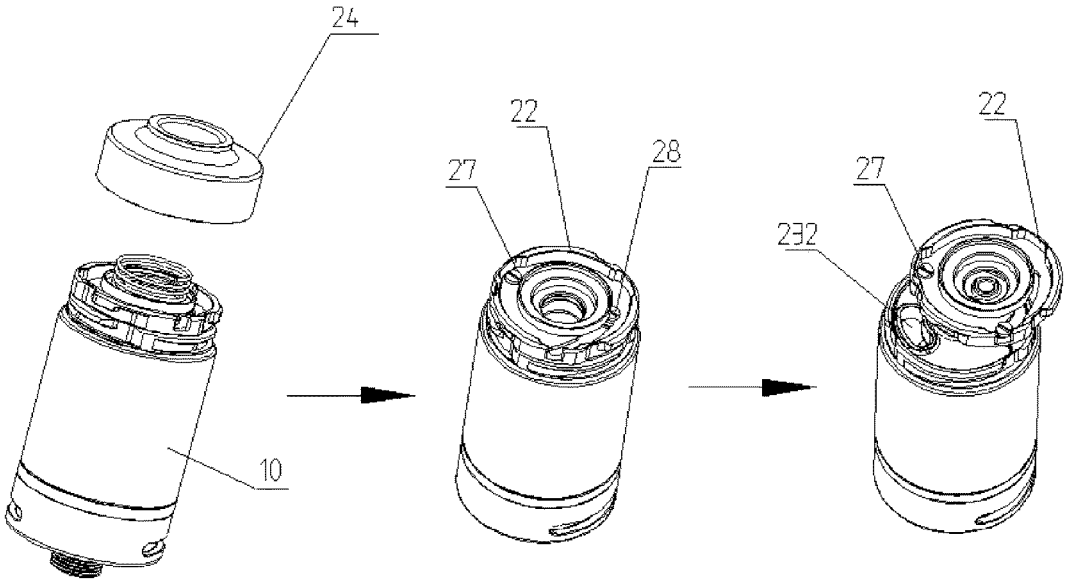
FIG. 9 is a state diagram showing the opening process of a liquid injection opening of the atomizer shown in FIG. 1.

Referring to FIG. 9, during liquid filling, the top cover 24 is rotated so that the locking projection 246 enters into the opening 218, and then the locking projection 246 enters into the lower guiding groove 227 under the action of an elastic force, rotates along the second engagement groove 225, then enters into the upper guiding groove 226 under the action of the elastic force, thereby releasing the top cover 24 from the liquid filling cap 21. And then the rotary cap 22 is rotated about the first rotating pin shaft 27 fitted in the pin shaft connection hole 223. Thus, the liquid injection hole 213 of the liquid filling cap 21 is exposed for filling tobacco liquid into the liquid storage assembly 10. It is not easy for children to open the top cover 24 of the atomizer of the present disclosure. The liquid injection hole 213 is concealed by the rotary cap 22 after the top cover 24 is opened, thus it has a child proof function.

It can be appreciated that, in other embodiments, each of the first engagement grooves 217 may correspond to two or more than two second engagement grooves 225, and the second engagement grooves 225 are spaced along the axis of the rotary cap 22. An upper guiding groove 226 is formed at one end of the uppermost second engagement groove 225, and a lower guiding groove 227 in communication with the opening 218 is formed at one end of the lowermost second engagement groove 225. The second engagement grooves 225 are communicated with one another through staggered communication grooves provided therebetween along the axis direction of the rotary cap 22, so that an "S" passage is formed between the second engagement grooves 225. During locking the top cover 24, the locking projection 246 enters into the passage through the upper guiding groove 226, and after passing through the passage, it can enter into the opening 218 through the lower guiding groove 227, and finally is fixed into the first engagement groove 217; the process of unlocking the top cover 24 is opposite to the above-described locking process and will not be described here. It can be appreciated that the more complex the passage between the second engagement grooves 225 is, the higher the protective performance is.

It can be appreciated that, in other embodiments, the rotary cap 22 may be omitted, and the second engagement groove 225, the upper guiding groove 226, and the lower guiding groove 227 may be provided on the liquid filling cap 22, the liquid injection hole 213 is sealed directly through the top cover 24. Alternatively, the liquid filling cap 21 can be directly detachably attached to the open end of a liquid storage space of the liquid storage assembly 10 without the injection hole 213, and when the liquid injection is required, the top cover 24 is removed, and then the liquid filling cap 21 is removed, thus the liquid can be injected.

Referring to FIG. 3, the atomizer head assembly 30 includes a connection tube 31 and an atomizer head 32 mounted inside the connection tube 31. The connection tube 31 includes a connection tube base 311 and a connection tube sleeve 312 provided on the connection tube base 311. The connection tube base 311 is provided with a communication hole (not shown), and an external thread for connecting to the base assembly 40 is formed at the bottom end of the connection tube base 311. A liquid inlet hole 3121 is formed in the peripheral wall of the connection tube sleeve 312 so that the tobacco liquid injected into the liquid storage tube 11 enters into an inner cavity of the connection tube sleeve 312. The inner cavity of the connection tube sleeve 312 communicates with the communication hole in the connection tube base 311. The upper end of the connection tube sleeve 312 is contracted, and an external thread is formed at the upper end thereof to be screwed with the connection sleeve 216 on the lower surface of the cover plate portion of the liquid filling cap 21.

Figure 10:
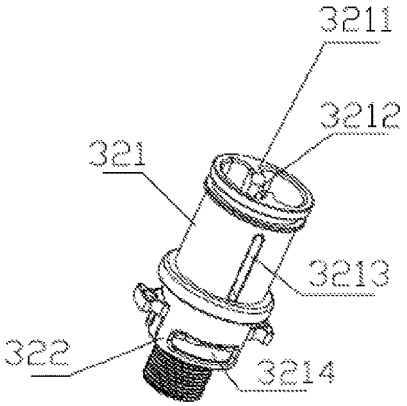
FIG. 10 is a perspective view of an atomizer head assembly of the atomizer shown in FIG. 1.
Figure 11:
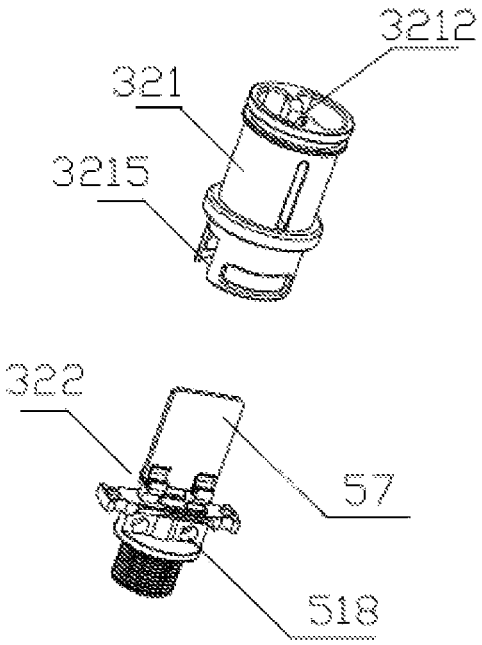
FIG. 11 is an exploded view of the atomizer head assembly shown in FIG. 10.
Figure 12:
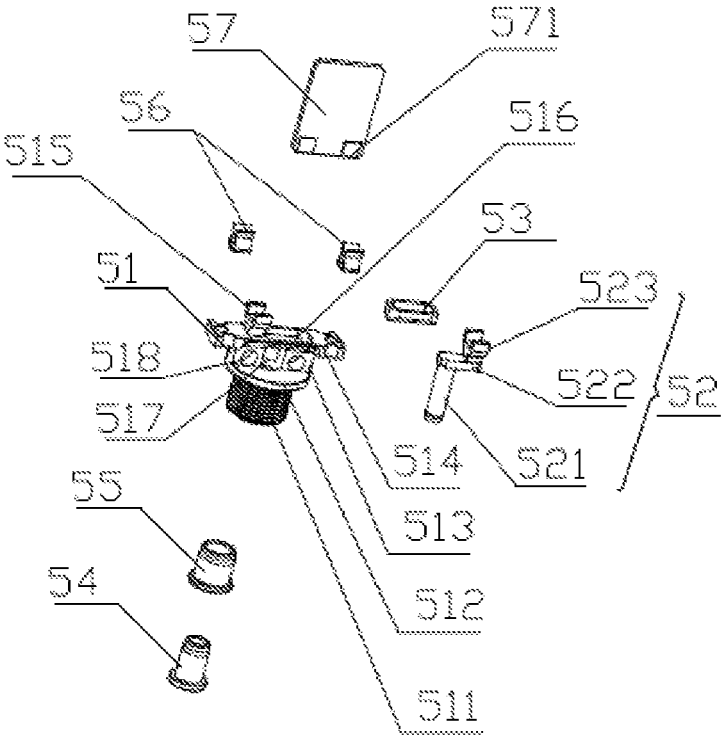
FIG. 12 is an exploded view of an atomizing heating assembly of the atomizer head assembly shown in FIG. 11.

Referring to FIGS. 10, 11 and 12, the atomizer head 32 includes an atomizing tube 321 and an atomizing heating assembly 322 cooperating with the atomizing tube 321. A positioning plate 3211 is provided in a tube cavity of the atomizing tube 321 along the direction of diameter of the atomizing tube 321, the positioning plate 3211 is provided with a third fixing groove 3212 along the axial direction of the atomizing tube 321. A peripheral wall of the atomizing tube 321 is provided with an exudate slot 3213 and an air inlet hole 3214, and the exudate slot 3213 is a long striped hole along the axial direction of the atomizing tube 321 for the infiltration of the tobacco liquid into the tube cavity of the atomizing tube 321. The air inlet hole 3214 is near to the bottom of the atomizing tube 321, for the airflow flowing into the tube cavity of the atomizing tube 321. A griping hole 3215 is provided at the bottom of the peripheral wall of the atomizing tube 321, so that the atomizing tube 321 can be mounted on the atomizing heating assembly 322. The atomizing heating assembly 322 includes a first electrode seat 51, a second electrode seat 52, an insulation sleeve 53, a conducting part 54, an insulated ring 55, a clipping piece 56 and a heating element 57. The first electrode seat 51 includes a bottom tube 511, a flat plate 512 disposed on the top of the bottom tube 511, a supporting plate 513 vertically disposed on the flat plate 512, and a mounting plate 514 horizontally disposed on the supporting plate 513. The outer periphery of the bottom tube 511 is formed with an external thread. A first gripping base 515 is arranged at the top surface of the mounting plate 514. The top surface of the mounting plate 514 further defines a mounting hole 516, the supporting plate 513 is provided with a mounting slot 517 and an ventilation hole 518, the bottom of the mounting slot 517 passes through the flat plate 512 and communicates with the tube cavity of the bottom tube 511, the top of the mounting slot 517 passes through the mounting plate 514 and communicates with the mounting hole 516, and the mounting hole 516 cooperates with the mounting slot 517 to mount the second electrode seat 52. The ventilation hole 518 is for the air flowing on both sides of the supporting plate 513. The second electrode seat 52 includes a rod body 521 and a plate body 522 connected to the top of the rod body 521. A second gripping base 523 is arranged on the top surface of the plate body 522. When the second electrode seat 52 is mounted on the first electrode seat 51, the rod body 521 is inserted into the mounting slot 517 and projected into the bottom tube 511, and the plate body 522 is mounted in the mounting hole 516. The insulation sleeve 53 is mounted in the mounting hole 516 to insulate the plate body 522 from the first electrode seat 51. The conducting part 54 is mounted in the tube cavity of the bottom tube 511 and engaged with an end of the rod body 521, and the insulated ring 55 is sleeved on an outer periphery of the conducting part 54 to insulate the conducting part 54 from the first electrode seat 51. There are two clipping pieces 56, which are mounted in the first gripping base 515 and the second gripping base 523 respectively. The heating element 57 is in the form of a plate. Two conductive gripping parts 571 are provided at the bottom of the heating element 57, and the heating element 57 is fixed by the cooperation of the two conductive gripping parts 571 and the two clipping pieces 56. It can be appreciated that a liquid absorbent cotton can be disposed around the outer periphery of the heating element 57. When the atomizing heating assembly 322 is mounted into the atomizing tube 321, both sides of the mounting plate 514 are caught into the gripping openings 3215 on the bottom side of the atomizing tube 321, and the heating element 57 is engaged with the third fixing groove 3212. It can be appreciated that the third fixing groove 3212 may further fix the heating element 57 to prevent the same from shaking under the action of airflow. It can be appreciated that the first electrode seat 51 may be a negative or a positive electrode seat. Correspondingly, the second electrode seat 52 is a positive or a negative electrode seat. In this embodiment, the first electrode seat 51 is a negative electrode seat, and the second electrode seat 52 is a positive electrode seat. Therefore, the heating element 57 is sandwiched between the first gripping base 515 and the second gripping base 523 by the clipping pieces 56. When the heating element 57 is damaged, it is only necessary to pull out the damaged heating element 57 with force, and then insert a new heating element 57. The entire replacement process is simple and convenient.

The clipping piece 56 is a stainless steel shrapnel which facilitates to fix the heating element 57 tightly.

It can be appreciated that, in other embodiments, the clipping piece 56 may be omitted. In this case, the heating element 57 can be tightly fixed by the cooperation of the first gripping base 515 and the second gripping base 523 which both made of elastic materials.

Referring back to FIG. 3, the base assembly 40 includes a base body 41 including a base body bottom plate 411 and a base body peripheral wall 412 formed on the seat body bottom plate 411. The base body bottom plate 411 is provided with a center through hole. A plurality of air inlet grooves 4121 are formed in the base body peripheral wall 412, and an inner peripheral surface of the base body peripheral wall 412 is provided with an internal thread on the upper side thereof, so as to engage with the external thread on the outer periphery of the bottom end of the connection tube base 311.

The air adjusting assembly 50 includes an air adjusting ring 501 rotatably sleeved on the outer periphery of the base body 41. A plurality of air adjusting holes 502 are formed in the peripheral wall of the air adjusting ring 501.

Figure 14:
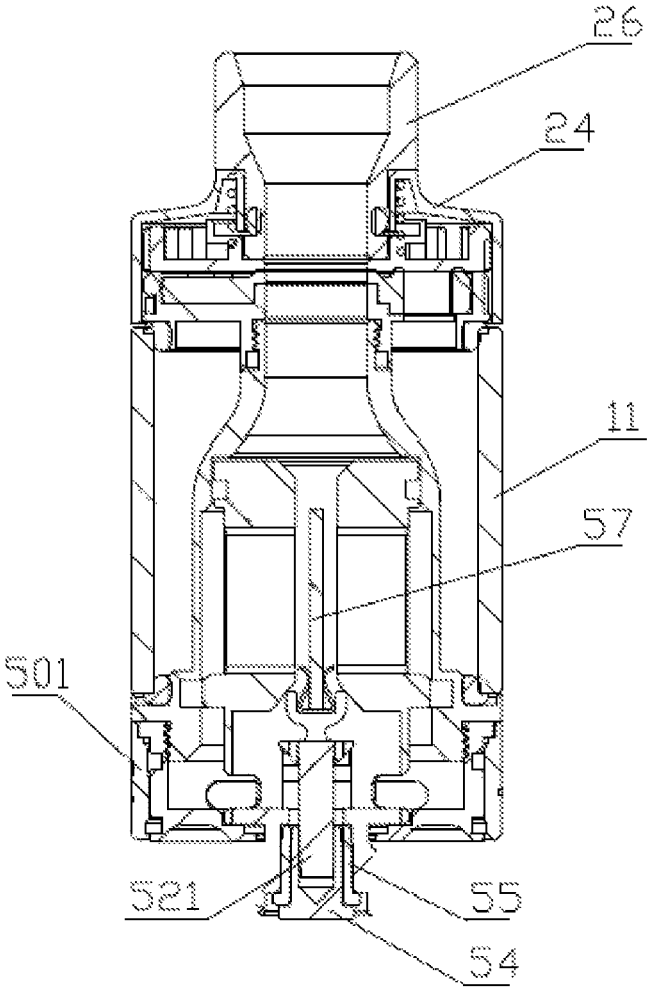
FIG. 14 is another sectional view of the atomizer shown in the FIG. 1.

Referring to FIGS. 13 and 14, when assembled, the atomizer head 32 is inserted into the connection tube 31 from the bottom end of the connection tube 31, and the bottom end of the connection tube 31 is screwed to the base body 41, so that the atomizer head 32 is stably mounted in the connection tube 31. The air inlet groove 4121 is substantially in the same horizontal position as the air intake hole 3214 of the atomizing tube 321 and the ventilation hole 518 of the atomizing heating assembly. The air adjusting ring 501 is rotatably sleeved on the outer periphery of the base body 41, and the air adjusting hole 502 in the air regulating ring 501 can be gradually aligned or staggered with respect to the air intake groove 4121, thereby adjusting the intake air amount. The liquid storage tube 11 is placed outside of the connection tube sleeve 312 and a liquid storage space is formed between the liquid storage tube 11 and the connection tube sleeve 312. The bottom end of the liquid storage tube 11 is hermetically fitted to the connection tube base 311, and the top end of the liquid storage tube 11 is hermetically fitted to the bottom end of the liquid filling cap 21.

When smoking, the outside airflow enters from the air adjusting hole 502, and enters into the tube cavity of the atomizing tube 321 through the air intake groove 4121 and the air inlet hole 3214. The airflow flows to both sides of the heating element 57 through the ventilation hole 518, and flows upward along the corresponding sides of the heating element 57, then flows out from the top end of the connection tube sleeve 312. After entering into the top connection assembly 20, the airflow flows out from the cigarette holder 26. In this way, the smoke can be fully brought out.

In another aspect, the present disclosure further provides an electronic cigarette including the atomizer.

The embodiments are chosen and described in order to explain the principles of the disclosure and their practical application so as to activate others skilled in the art to utilize the disclosure and various embodiments. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

The invention claimed is:

1. An atomizer head, comprising:

an atomizing heating assembly, comprising:

a first electrode seat, a second electrode seat insulatedly mounted to the first electrode seat, and a heating element electrically connected to the first electrode seat and the second electrode seat, wherein the first electrode seat is provided with a first gripping base, the second electrode seat is provided with a second gripping base, and the heating element is detachably connected to the first electrode seat and the second electrode seat respectively through the first gripping base and the second gripping base.

2. The atomizer head according to claim 1, further comprising an atomizing tube, wherein a positioning plate is provided in a tube cavity of the atomizing tube along a direction of diameter of the atomizing tube, the positioning plate is provided with a third fixing groove along an axial direction of the atomizing tube, the atomizing tube is sleeved on a periphery of the heating element, and the heating element is further detachably engaged in the third fixing groove.

3. The atomizer head according to claim 2, wherein a peripheral wall of the atomizing tube is provided with an exudate slot along the axial direction of the atomizing tube, and the peripheral wall of the atomizing tube adjacent to a bottom of the atomizing tube is provided with an air inlet hole.

4. The atomizer head according to claim 2, wherein two gripping openings which grip two ends of the first electrode seat are provided at the bottom of the peripheral wall of the atomizing tube.

5. The atomizer head according to claim 1, wherein the first electrode seat comprises:

a bottom tube, a flat plate disposed on a top of the bottom tube, a supporting plate vertically disposed on the flat plate, and a mounting plate horizontally disposed on the supporting plate;

the first gripping base is arranged on a top surface of the mounting plate, the top surface of the mounting plate is also provided with a mounting hole, the supporting plate is provided with a mounting slot and an ventilation hole, the bottom of the mounting slot extends through the flat plate and communicates with the tube cavity of the bottom tube, the top of the mounting slot extends through the mounting plate and communicates with the mounting hole, and the mounting hole cooperates with the mounting slot to mount the second electrode seat.

6. The atomizer head according to claim 5, wherein the second electrode seat includes a rod body and a plate body connected to a top of the rod body, the second gripping base is arranged on a top surface of the plate body, the rod body is inserted into the mounting slot and projected into the bottom tube, and the plate body is mounted in the mounting hole.

7. The atomizer head according to claim 6, wherein the atomizing heating assembly further comprises an insulation sleeve, a conducting part and an insulated ring, the insulation sleeve is mounted in the mounting hole to insulate the plate body of the second electrode seat from the first electrode seat, the conducting part is mounted in the tube cavity of the bottom tube and engaged with an end of the rod body, and the insulated ring is sleeved on an outer periphery of the conducting part to insulate the conducting part from the first electrode seat.

8. The atomizer head according to claim 1, wherein the atomizing heating assembly further comprises two clipping pieces mounted in the first gripping base and the second gripping base respectively, and two conductive gripping parts are provided at the bottom of the heating element corresponding to the two clipping pieces.

9. An atomizer, comprising:

an atomizer head, comprising:

a first electrode seat, a second electrode seat insulatedly mounted to the first electrode seat, and a heating element electrically connected to the first electrode seat and the second electrode seat, wherein the first electrode seat is provided with a first gripping base, the second electrode seat is provided with a second gripping base, and the heating element is detachably connected to the first electrode seat and the second electrode seat respectively through the first gripping base and the second gripping base.

10. The atomizer according to claim 9, wherein the atomizer head further comprises an atomizing tube, a positioning plate is provided in a tube cavity of the atomizing tube along a direction of diameter of the atomizing tube, the positioning plate is provided with a third fixing groove along an axial direction of the atomizing tube, the atomizing tube is sleeved on a periphery of the heating element, and the heating element is further detachably engaged in the third fixing groove.

11. The atomizer according to claim 10, wherein a peripheral wall of the atomizing tube is provided with an exudate slot along the axial direction of the atomizing tube, and the peripheral wall of the atomizing tube adjacent to a bottom of the atomizing tube is provided with an air inlet hole.

12. The atomizer according to claim 10, wherein two gripping openings which grip two ends of the first electrode seat are provided at the bottom of the peripheral wall of the atomizing tube.

13. The atomizer according to claim 9, wherein the first electrode seat comprises:

a bottom tube, a flat plate disposed on a top of the bottom tube, a supporting plate vertically disposed on the flat plate, and a mounting plate horizontally disposed on the supporting plate;

the first gripping base is arranged on a top surface of the mounting plate, the top surface of the mounting plate is also provided with a mounting hole, the supporting plate is provided with a mounting slot and an ventilation hole, the bottom of the mounting slot extends through the flat plate and communicates with the tube cavity of the bottom tube, the top of the mounting slot extends through the mounting plate and communicates with the mounting hole, and the mounting hole cooperates with the mounting slot to mount the second electrode seat.

14. The atomizer head according to claim 13, wherein the second electrode seat includes a rod body and a plate body connected to a top of the rod body, the second gripping base is arranged on a top surface of the plate body, the rod body is inserted into the mounting slot and projected into the bottom tube, and the plate body is mounted in the mounting hole.

15. The atomizer head according to claim 14, wherein the atomizing heating assembly further comprises an insulation sleeve, a conducting part and an insulated ring, the insulation sleeve is mounted in the mounting hole to insulate the plate body of the second electrode seat from the first electrode seat, the conducting part is mounted in the tube cavity of the bottom tube and engaged with an end of the rod body, and the insulated ring is sleeved on an outer periphery of the conducting part to insulate the conducting part from the first electrode seat.

16. An electronic cigarette, comprising:

an atomizer, comprising:

a first electrode seat, a second electrode seat insulatedly mounted to the first electrode seat, and a heating element electrically connected to the first electrode seat and the second electrode seat, wherein the first electrode seat is provided with a first gripping base, the second electrode seat is provided with a second gripping base, and the heating element is detachably connected to the first electrode seat and the second electrode seat respectively through the first gripping base and the second gripping base.

17. The electronic cigarette according to claim 16, wherein the atomizer further comprises an atomizing tube, a positioning plate is provided in a tube cavity of the atomizing tube along a direction of diameter of the atomizing tube, the positioning plate is provided with a third fixing groove along an axial direction of the atomizing tube, the atomizing tube is sleeved on a periphery of the heating element, and the heating element is further detachably engaged in the third fixing groove.

18. The electronic cigarette according to claim 17, wherein a peripheral wall of the atomizing tube is provided with an exudate slot along the axial direction of the atomizing tube, and the peripheral wall of the atomizing tube adjacent to a bottom of the atomizing tube is provided with an air inlet hole.

19. The electronic cigarette according to claim 17, wherein two gripping openings which grip two ends of the first electrode seat are provided at the bottom of the peripheral wall of the atomizing tube.

20. The electronic cigarette according to claim 16, wherein the atomizer further comprises two clipping pieces mounted in the first gripping base and the second gripping base respectively, and two conductive gripping parts are provided at the bottom of the heating element corresponding to the two clipping pieces.

* * * * *